United States Patent [19]

Roberts, Jr.

[11] Patent Number: 4,696,504

[45] Date of Patent: Sep. 29, 1987

[54] BOOT CARRIER

[76] Inventor: Roland Q. Roberts, Jr., 4135 Jonquil Cir. North, Palm Beach Gardens, Fla. 33410

[21] Appl. No.: 913,521

[22] Filed: Sep. 30, 1986

[51] Int. Cl.[4] ..... B65D 63/18

[52] U.S. Cl. ..... 294/148; 294/150; 294/163; 294/164; 294/165

[58] Field of Search ..... 294/137, 148–150, 294/153–156, 159, 162–168; 12/120.5; 211/34, 38; 224/250

[56] References Cited

U.S. PATENT DOCUMENTS 3,608,795 9/1971 Klein et al. ..... 294/162 X
3,775,794 12/1973 Fisher ..... 294/162 X
4,244,498 1/1981 Copp ..... 294/162
4,537,436 8/1985 Pfortmiller ..... 294/164 X

FOREIGN PATENT DOCUMENTS 2916392 11/1980 Fed. Rep. of Germany ..... 294/165

*Primary Examiner*—Johnny D. Cherry
*Attorney, Agent, or Firm*—Jack N. McCarthy

[57] ABSTRACT

A boot carrier having a flexible U-shape portion forming the weight-bearing member, for passing under a pair of boots, and a handle; a holding or stabilizing member slidably mounted on the flexible U-shape portion, for engaging the shafts of a pair of boots, with a flexible U-shape portion extending outwardly from the holding or stabilizing member for passing around the back of a pair of boots.

11 Claims, 6 Drawing Figures

BOOT CARRIER

DESCRIPTION

1. Technical Field

This invention relates to a device to carry boots or shoes of almost any type or size with ease and comfort. It is particularly suited to ski boots because their size and bulk have made them too unwieldly to carry without the aid of such a device.

2. Background Art

Many boot carrying devices are available today. Those tried were lacking in simplicity of application, ease in carrying, or convenience when you set the boots down. Some boot trees and similar devices placed the boots in a sole-to-sole position. A "T" handle device is also used. While it is compact, it relies on a single point of suspension. Some boot carrying devices are shown in the following patents: U.S. Pat. Nos. 2,679,937; 3,183,535; 3,587,951; 3,600,734; 3,775,794; and Re. 28,001.

SUMMARY OF THE INVENTION

One object of the present invention is to provide a boot carrier which allows the boots to be carried in a side-by-side position and does not depend on any of the boot's fastening mechanisms, and when carried, there is no twist or spin because of a two-point suspension system. When the boots are put down, the device stays in place and because the boots are in a side-by-side position, they do not tip over easily. The device itself is small enough to fit into your pocket and is inexpensive.

Another object of the invention is to provide a boot carrier having two flexible loops, one flexible down cord loop and one variable length retention cord loop, said variable length retention cord loop having a sliding connection on opposite sides of said flexible down cord loop; said flexible down cord loop being of a length for extending under the mid-portion of a pair of boots, one portion of said variable length retention cord loop between said sliding connections being placed to extend around the front of the upper boot shaft, the other portion of said variable length retention cord loop being placed to extend around the back of the boot shaft.

A further object of the invention is to provide two connectors for connecting two loops of cord together at two locations, a down cord loop and a retention cord loop, said down cord loop having a connector member on each side thereof for slidable movement thereon, said retention cord loop being positioned by each of said connectors to provide a front boot toe engaging portion between the sides of said down cord loop and a back of the boot engaging portion between the sides of said down cord loop.

Another object of the invention is to provide a connector to attach one cord loop to another cord loop at two locations and allow slidable movement therebetween.

A further object of the present invention is to provide a boot carrier having a rigid handle with a flexible cord fixed thereto, said cord having spaced portions extending from one end of the handle to the other, said flexible cord being of a length for extending under the mid-portion of a boot; a rigid holding or stabilizing member being slidably mounted at each end on each spaced portion of said flexible cord extending downwardly from said rigid handle for movement between said rigid handle and bottom curved portion of said flexible cord for engaging the top of a boot toe. An elastic retention cord is fixed to each end of said holding or stabilizing member for extending around the back of a boot.

BEST MODE FOR CARRYING OUT THE INVENTION

Figure 1:
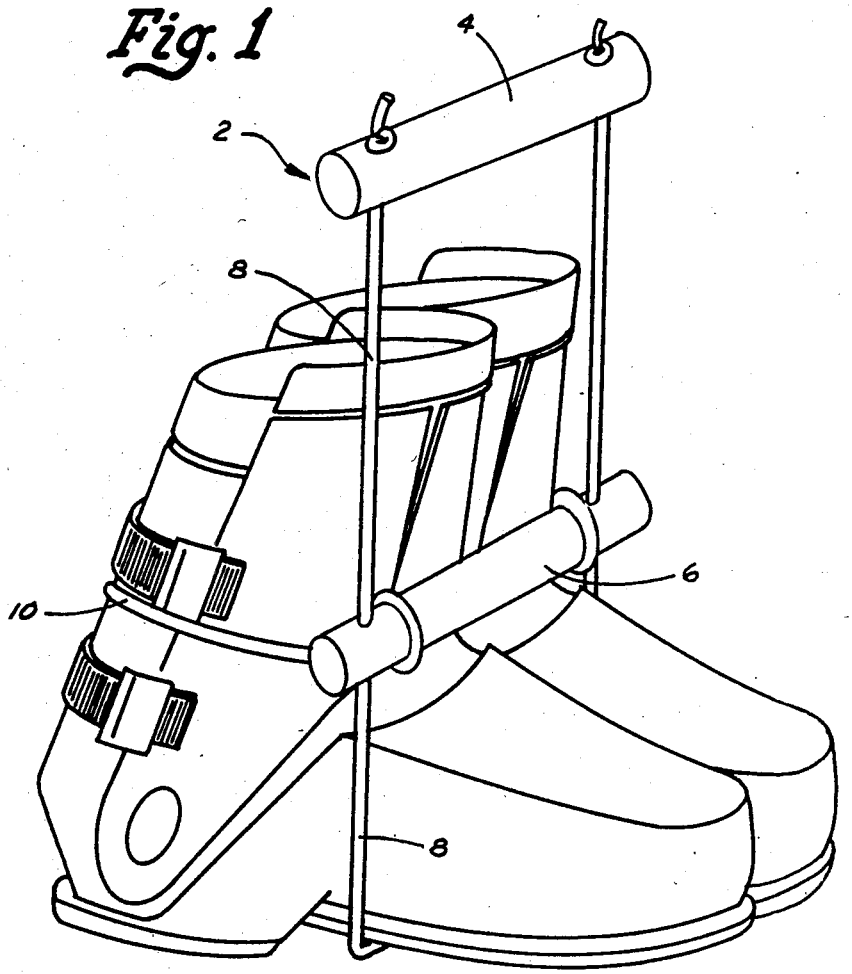
FIG. 1 is a perspective view of the boot carrier holding a pair of ski boots.
Figure 2:
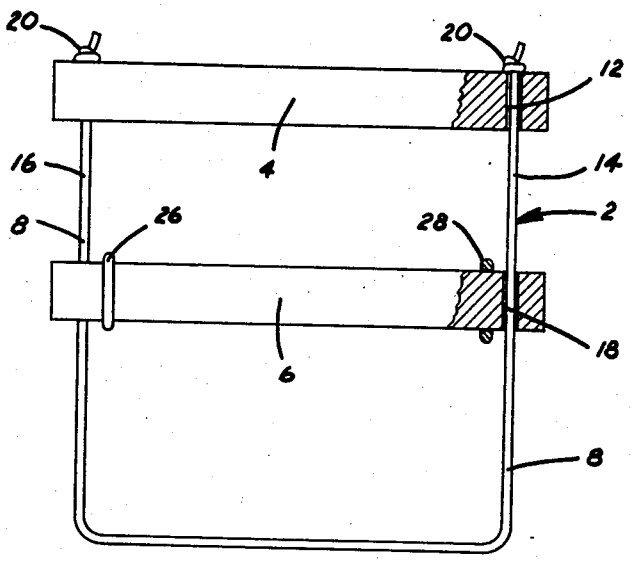
FIG. 2 is a front view of the carrier.
Figure 4:
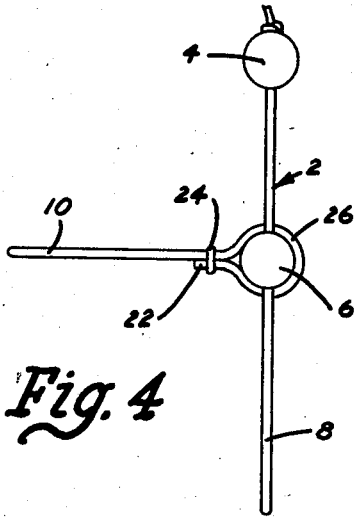
FIG. 4 is a side view of the carrier.
Figure 3:
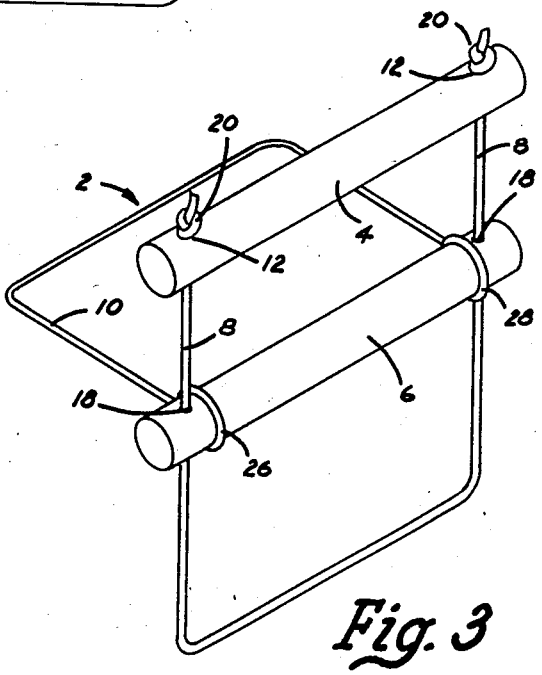
FIG. 3 is a perspective view of the carrier with the boots removed.

As illustrated in the drawings, the boot carrier 2 is comprised of four main parts: a handle 4; a holding or stabilizing bar 6; a flexible down cord 8; and an elastic retention cord 10. The handle 4 has a hole 12 through each end to receive the ends 14 and 16 of the flexible down cord 8 in a manner to be hereinafter described.

The holding or stabilizing bar 6 also has a hole 18 through each end, through which the ends 14 and 16 of the flexible down cord 8 are passed before they are passed through the holes 12 of the handle 4 and tied in a knot 20 to prevent them from being pulled back through their respective holes 12. This arrangement permits the holding or stabilizing bar 6 and the handle 4 to slide freely on the flexible down cord 8.

An elastic retention cord, or stretchable retention means, 10, has one end fixed to the holding or stabilizing bar 6 adjacent one hole 18 and its other end fixed to the holding or stabilizing bar 6 adjacent the other hole 18. Each end of said elastic retention cord 10 extends around the holding or stabilizing bar 6 with the free end 22 being placed against retention cord 10 and fastened thereto, such as by a clip 24. It can be seen that this forms a loop 26 at one end of the elastic retention cord 10 and a loop 28 at the other end. These loops 26 and 28 are slidable along the holding or stabilizing bar 6 between the holes 18 and can be moved outwardly against the flexible down cord 8 which passes through the adjacent hole 18.

A preferred embodiment of the invention utilizes a rigid material for the handle 4 and the holding or stabilizing bar 6. In a construction made, a wooden rod was used; however, a similar piece of plastic or metal, solid or hollow, could be used. The flexible down cord 8 was made of a flexible, non-elastic cord, but other flexible members could be used. The elastic retention cord 10 was made from a bungee cord. Other elastic materials and devices can be used, such as a shock cord or rubber cord, or a flexible cord with small spring means therein. The clips 24 can be any type of holding means which will hold the elastic retention cord 10 to itself to form a loop 26 or 28. The knots 20, which prevent the handle 4 from being detached from the flexible down cord 8, can be replaced by a fastening means which would prevent the flexible down cord from being pulled out of the holes 12.

The boot carrier 2 can be placed on a pair of boots in the following manner: First, place the boots in a side-by-side position with the toes pointing in the same direction; second, hold the boot carrier 2 by the handle 4 and place the flexible down cord 8 under the soles of the boots toward the arch or middle of the boot; third, slide the holding or stabilizing bar 6 downwardly against the boot shaft and place the elastic retention cord 10 over the upwardly extending portion of the boot shaft around the rear of the boot; and fourth, lift the handle 4 and the carrier 2 will adjust itself.

If desired, a boot carrier 2 can be customized to fit a specific pair of boots by making the elastic retention cord 10 a desired length between the clips 24 and lengthening or shortening the flexible down cord 8 to a desired length. It is noted that the upper ends of the flexible down cord 8 can be connected together, forming a handle.

Figure 5:
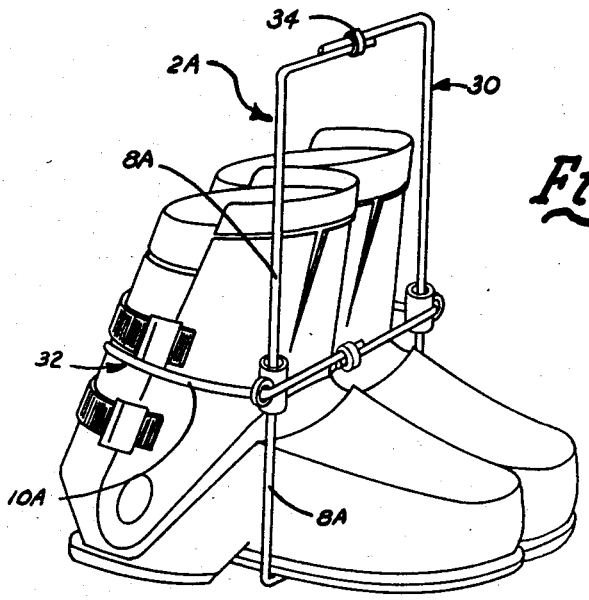
FIG. 5 is a perspective view of another embodiment of a boot carrier holding a pair of ski boots.
Figure 6:
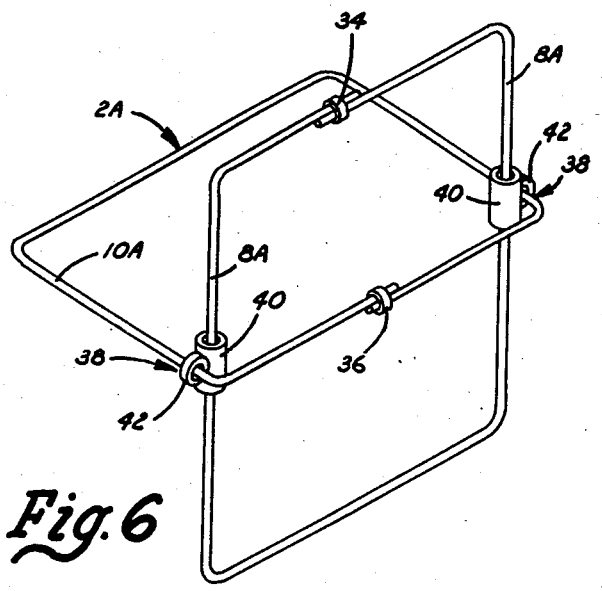
FIG. 6 is a perspective view of the embodiment shown in FIG. 5.

Another modification of the boot carrier 2A is shown in FIGS. 5 and 6, comprising basically two flexible loops, one flexible down cord loop 30 and one variable length retention cord loop 32. Flexible down cord loop 30 is formed from a length of flexible cord 8A fixed together at its ends by a clip 34 (similar to clip 24). The variable length retention cord loop 32 is formed from a length of elastic cord 10A fixed together at its ends by a clip 36 (similar to clips 24 and 34), said flexible down cord loop 30 and variable length retention cord loop 32 being connected together at two points, each by connecting means 38. Each connecting means 38 is formed having a short cylindrical section 40 through which flexible cord 8A extends. A ring member 42 is fixed to the side of the short cylindrical section 40, such as by welding, with its open portion having a center line which is approximately 90° to the center line of the passage of the short cylindrical section 40, through which elastic cord 10A extends.

The boot carrier 2A can be placed on a pair of boots in the following manner: First, place the boots in a side-by-side position with the toes pointing in the same direction; Second, hold the boot carrier 2A by the flexible cord 8A of flexible down cord loop 30 and place the lower part of the flexible cord 8A under the soles of the boots toward the arch or middle of the boot; Third, slide the forward part of the elastic cord 10A of the variable length retention cord loop 32 downwardly against the top of the front of the boot shaft and place the rearward part of the elastic cord 10A over the upwardly extending portion of the boot around the rear of the boot shaft; and Fourth, lift the boot by the flexible cord 8A and the carrier 2A will adjust itself.

Clips 34 and 36 can be replaced by an adjustable clip which will permit adjusting of the length of the flexible down cord loop 30 or variable length retention cord loop 32, if desired. If a non-elastic cord 10A is used for the variable length retention cord loop 32, an adjustable clip is necessary, or a buckle in the loop 32, to permit changing of the length of the loop 32 to accommodate extension around a particular size of boots.

A connecting means 38 can be any device which joins two cords together and allows sliding movement through the device at approximately 90° to each other. If a boot carrier 2A is custom made, the connecting means 38 can have the ring member 42 designed to squeeze or hold an elastic cord 10A at the desired width of the two boots to be carried.

I claim:

1. A boot carrier comprising a handle of rigid material with two holes therethrough, one hole near each end of the handle; a solid holding bar of rigid material with two holes through it, one hole near each end of the holding bar; a flexible down cord of nonelastic material, said cord extending through the hole at one end of the handle and then through the hole at one end of the solid holding bar and forming a U-shape for extending around the bottom of a boot and then extending through the other hole in the other end of the solid holding bar and then through the other hole in the other end of the handle; stop means connected to the ends of the down cord to prevent the down cord from slipping through the holes in the handle, the solid holding bar being slidable up and down on the flexible down cord between the handle and the bottom of the U-shape for placement against a boot shaft; a stretchable retention cord; means connecting each end of said retention cord to the solid holding bar for extending around the back of a boot shaft, each end of said stretchable retention cord having a loop, said connecting means including each loop being located over said solid holding bar between said two holes in said solid holding bar.

2. A boot carrier having two connected flexible loop structures, one flexible loop structure comprising a handle section and a down cord section of nonelastic material forming a U-shape, said U-shape having two spaced arm sections; a second flexible loop structure comprising a variable length retention cord; means connecting the flexible variable length retention cord to the flexible down cord section for relative movement at two locations below said handle section, each connecting means being separate and having an opening means therethrough for said loop structure and said second loop structure, an arm section of said flexible down cord extending through each opening means for slidable movement.

3. A combination as set forth in claim 2 wherein said handle section is the top of the one loop structure.

4. A boot carrier as set forth in claim 2 wherein said one flexible loop structure comprises only a length of flexible cord having two ends, means fixing the two ends of said flexible cord together forming a flexible cord loop.

5. A boot carrier as set forth in claim 4 wherein said means fixing the two ends of said flexible cord together is a clip.

6. A boot carrier as set forth in claim 5 wherein said second flexible loop structure comprises a length of elastic cord having two ends, means fixing the two ends of said elastic cord together forming an elastic cord loop, said means fixing the two ends of said elastic cord together being a clip.

7. A boot carrier as set forth in claim 4 wherein said second flexible loop structure comprises a length of elastic cord having two ends, means fixing the two ends of said elastic cord together forming an elastic cord loop.

8. A boot carrier as set forth in claim 2 wherein said second flexible loop structure comprises only a length of elastic cord having two ends, means fixing the two ends of said elastic cord together forming an elastic cord loop.

9. A boot carrier as set forth in claim 8 wherein said means fixing the two ends of said elastic cord together is a clip.

10. A boot carrier having two connected flexible loop structures, one loop structure of non-elastic cord, a second loop structure of elastic cord, means connecting the loop structure of non-elastic cord to the loop structure of elastic cord at two locations, said connecting means including two spaced connectors, each spaced connector having a first opening means for receiving said non-elastic cord therethrough and a second opening means for receiving said elastic cord therethrough, each connecting means joining said non-elastic and elastic cords together for sliding movement relative to each other.

11. A boot carrier as set forth in claim 10 wherein each connector is fixed to said elastic cord to fixedly space said connectors at a desired width.

* * * * *